US005440463A

United States Patent [19]

Ellion

[11] Patent Number: 5,440,463

[45] Date of Patent: Aug. 8, 1995

[54] FLASHLIGHT LAMP CONFIGURATION TO PRODUCE EITHER A SPOT OR BROAD BEAM WITH ENHANCED BRIGHTNESS

[76] Inventor: M. Edmund Ellion, 3660 Woodstock Rd., Santa Ynez, Calif. 93460

[21] Appl. No.: 118,472

[22] Filed: Sep. 8, 1993

[51] Int. Cl.[6] ..... F21L 3/00; F21M 3/18

[52] U.S. Cl. ..... 362/188; 362/212; 362/213; 362/350

[58] Field of Search ..... 313/148, 149; 362/187, 362/188, 211, 212, 213, 35, 208, 285, 287, 296, 350

[56] References Cited

U.S. PATENT DOCUMENTS

| | | | |
|---|---|---|---|
| 1,279,061 | 9/1918 | Winston | 362/213 |
| 4,598,342 | 7/1986 | English et al. | 362/213 |
| 4,644,452 | 2/1987 | Kasboske | 362/212 |

FOREIGN PATENT DOCUMENTS

| | | | |
|---|---|---|---|
| 250497 | 3/1964 | Australia | 362/211 |
| 796166 | 10/1968 | Canada | 362/211 |

*Primary Examiner*—Ira S. Lazarus
*Assistant Examiner*—Alan B. Cariaso
*Attorney, Agent, or Firm*—Donald D. Mon

[57] ABSTRACT

A unique two filament flashlight lamp in which one filament is energized to produce a spot beam and the second filament is energized to produce a broad beam. A spot beam is formed when the filament is energized whose axis is perpendicular to the reflector axis and whose center is at the reflector focal point, a broad beam is formed when the second filament is energized whose axis coincides with the reflector axis and has one end located close to the focal point.

In the second embodiment, a lamp having a single filament whose center is located at the reflector focal point and whose axis is perpendicular to the reflector axis will produce a spot beam. The lamp and filament can be reoriented so that the filament axis coincides with the reflector axis and one end of the filament is close to the reflector focal point to produce a broad beam.

4 Claims, 6 Drawing Sheets

FLASHLIGHT LAMP CONFIGURATION TO PRODUCE EITHER A SPOT OR BROAD BEAM WITH ENHANCED BRIGHTNESS

FIELD OF THE INVENTION

This invention relates to hand held flashlights with selectable beam sizes.

BACKGROUND OF THE INVENTION

The conventional flashlight employs a paraboloidal reflector to direct the light emitted from the lamp to the scene to be illuminated. For simplicity of explanation, consider the light source to be a point. If the point light source is positioned at the focus of the paraboloid, a concentrated beam is formed. This beam is the size of the maximum diameter of the reflector and is referred to as the spot beam. Some flashlights have a means to position the lamp to a different location along the axis of the reflector either by moving the lamp or the reflector. These flashlights are referred to as adjustable or focusable flashlights. When the point source of light is displaced from the focal point along the axis of the reflector, the beam that is formed illuminates a larger area of the scene. As the light source is displaced farther from the focal point, the beam gets larger and an unilluminated center disc is formed. This beam is referred to as the broad beam and the unilluminated disc is referred to as the black spot.

The Ellion reflector of U.S. Pat. No. 4,984,140 is a modified paraboloid that eliminates the black spot in the broad beam.

The lamp is inserted into the reflector in the typical flashlight through a hole at the apex of the reflector. The portion of the reflector that accomodates the lamp is not a reflective surface and as a result will not reflect the emitted light. The hole through which the lamp is inserted in approximately 0.6 inch in diameter for the "D" size flashlight whose maximum diameter of the reflector is approximately 2 inches. The cross-sectional area of the hole is approximately nine percent of the area at the maximum diameter of the reflector. The other size flashlights have correspondingly sized holes and maximum diameters of the reflectors. As a result of the hole, approximately nine percent of the potential projected light is lost. In addition to this decrease in the amount of light that is reflected, there would be an unilluminated center disc for the spot beam that is formed from the ideal point light source.

It is the object of this invention to produce either a spot beam or a broad beam without the black spot with the use of a standard paraboloidal reflector. It is an additional objective of this invention to produce a brighter spot and broad beam by utilizing the area of the reflector near the apex of the reflector. It is another object of this invention to produce either a spot beam or a broad beam without requiring the movement of the lamp relative to the paraboidal reflector in the two filament embodiment. It is a further object of this invention to produce a spot beam or a broad beam without a black spot in the second embodiment using a conventional single filament lamp and a paraboloidal reflector by rotating the filament from a position that is perpendicular to the reflector axis to one that is in line with the reflector axis.

BRIEF DESCRIPTION OF THE INVENTION

A flashlight according to this invention has a conventional paraboloidal reflector in which a unique two filament lamp is positioned in one embodiment. This first embodiment of this invention consists of a two filament lamp having the first filament located in the lamp so that its center will be positioned at the focal point of the reflector. The axis of this filament is positioned perpendicular to the axis of the reflector as in a conventional lamp. A second filament in the lamp is positioned with its axis along the axis of the reflector with one end located at the focal point. Each filament can be energized individually through a switching circuit. When the first filament is energized, a spot beam is formed. When the second filament is energized, a completely illuminated broad beam is formed.

The second embodiment of this invention consists of a paraboloidal reflector in which a conventional lamp is positioned with the filament located perpendicular to the reflector axis and with its center located at the focal point of the reflector. This position of the lamp when energized with produce a spot beam. The lamp can be repositioned relative to the reflector so that the filament is located along the axis of the reflector with one end close to the focal point. This position of the lamp, when energized, will produce a broad beam.

The above and other features of this invention will be fully understood from the detailed description and the accompanying drawings in which:

DETAILED DESCRIPTION OF THE INVENTION

In order to fully understand the teachings of this patent it will helpful to review briefly some fundamentals of light reflection from a paraboidal reflector.

Figure 1:
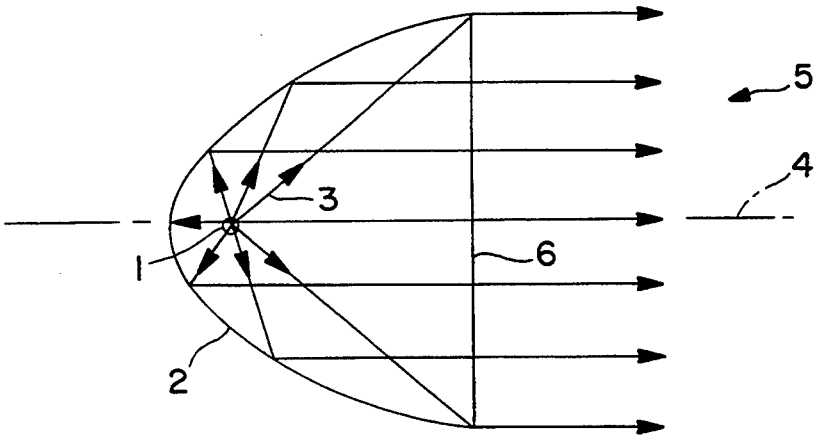
FIG. 1 is a cross section of a paraboloidal reflector with a point source of light located at the focal point that produces a spot beam.

FIG. 1 illustrates a point source of light 1 that is located at the focal point "O" of the paraboloidal reflector 2. It is well known that all of the light rays 3 leaving the source will be spectrally reflected parallel to the reflector axis 4 to form a concentrated beam 5 the same size as the maximum diameter of the reflector 6.

Figure 2:
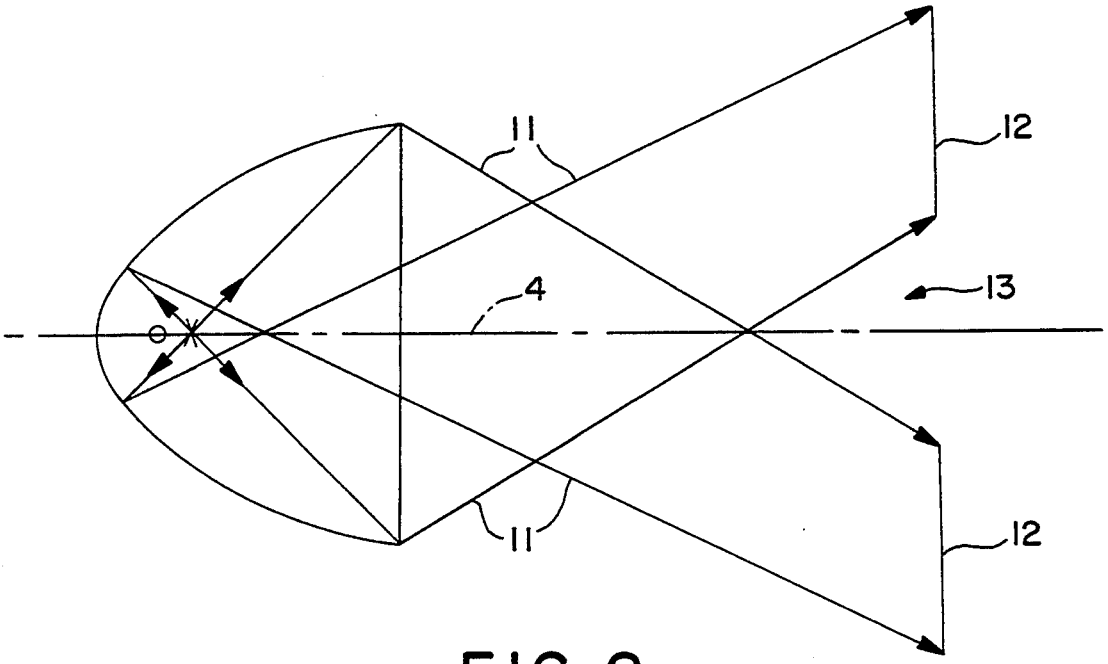
FIG. 2 illustrates the broad beam that is formed when the point source of light is located towards the open end of the reflector from the focal point.

FIG. 2 illustrates the point light source moved from the focal point "O" of the reflector to point "X" which is located on the reflector axis 4. The light rays that are reflected 11 will cross over the reflector axis as illustrated in FIG. 2. If the light source is displaced further, a larger broad beam 12 is formed with an unilluminated center disc 13.

Figure 3:
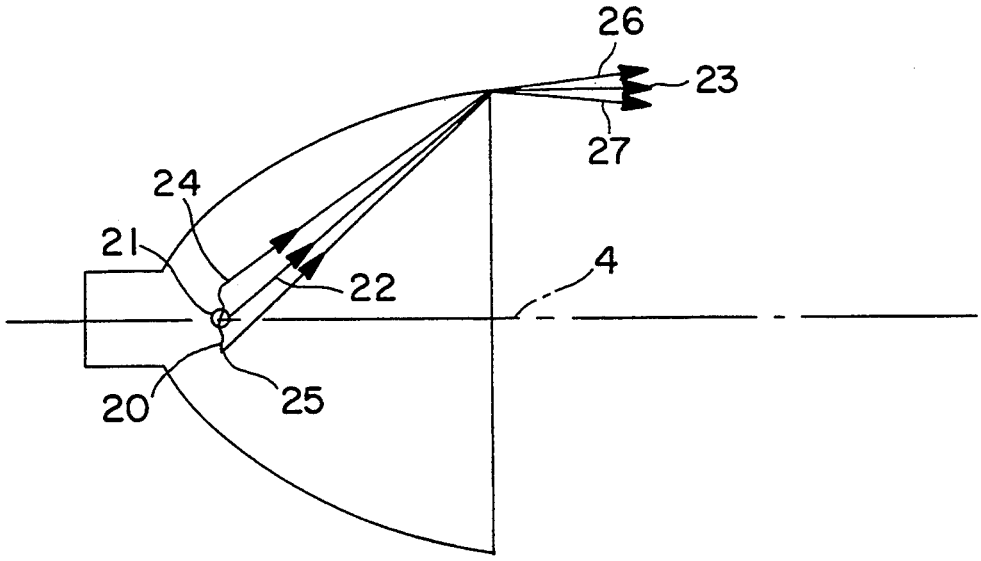
FIG. 3 illustrates the effect of a finite filament length rather than a point source of light.

FIG. 3 illustrates a conventional finite length incandescent filament 2 that is positioned perpendicular to the reflector axis 4 and is located so that the center 21 is coincident with the reflector focal point "O". The filament is enlarged for clarity. When this filament is energized, it will form the conventional spot beam. The light rays 22 originating from the center of the filament 21 which is located at the reflector focal point will emerge 23 parallel to the reflector axis 4. The light rays that originate from the ends of the filament 24, 25 will emerge 26, 27 at angles to the reflector axis 4.

Figure 4:
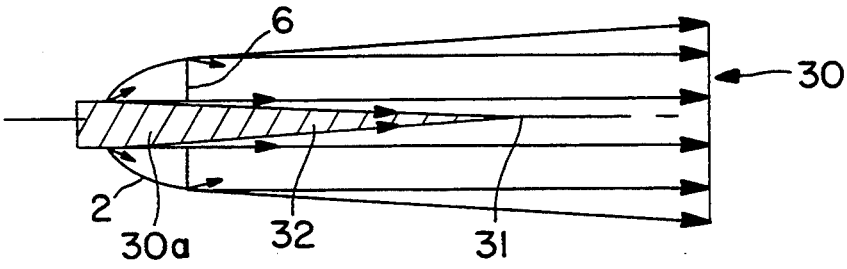
FIG. 4 illustrates the spot beam that is formed from a finite length filament.

FIG. 4 illustrates the spot beam that is formed from a finite length filament 30*a*. The spot beam 30 that is formed is larger than the maximum diameter 6 of the reflector 2 and for a scene that is less than a center distance 31, the center region 30 will be unilluminated. In order to eliminate this unilluminated center for scenes at short distances, the center of the filament must be moved away from the focal point and consequently result in a larger than ideal spot beam.

Figure 5:
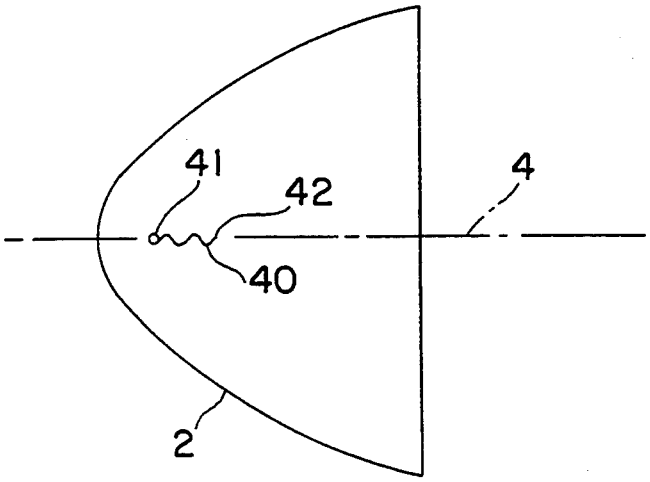
FIG. 5 is a geometric drawing showing a finite length filament coincident to the reflector axis.
Figure 6:
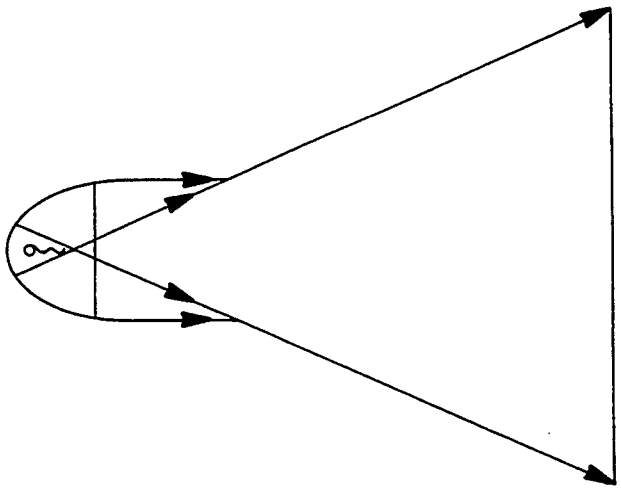
FIG. 6 illustrates the fully illuminated broad beam formed from a finite length filament whose axis coincides with the reflector axis.

FIG. 5 illustrates a filament 40 of an incandescent flashlight lamp whose axis is positioned to lie along the axis of the reflector 4. One end of the filament 41 is located at the focal point "O" of the reflector 2. Light originating from the point 41 will be reflected to form a concentrated spot beam as illustrated in FIG. 1. The light originating from the other end of the filament 42 will form a broad beam with an unilluminated center as illustrated in FIG. 2. The light originating between these two extreme points 41 and 42 will fill in the beam between the spot and the large ring. The result is a broad beam that is fully illuminated without the black center disc as is illustrated in FIG. 6.

Figure 7:
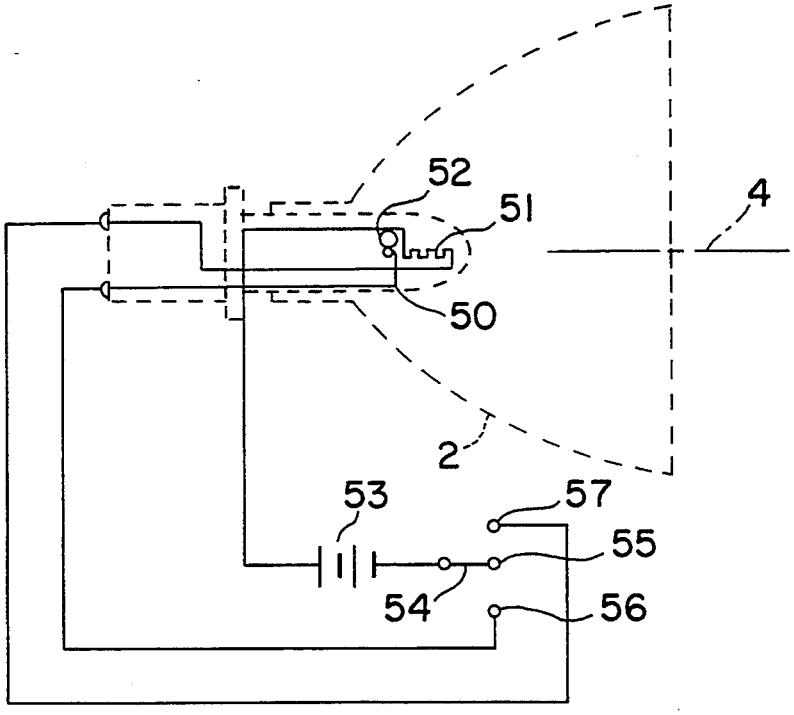
FIG. 7 is a schematic drawing of the two filament configuration of this invention with a typical control circuit.

FIG. 7 illustrates the two filaments 50 and 51 in the single lamp according to this invention. The lamp is positioned in the conventional paraboidal reflector 2 (shown in phatom) so that the center of the first filament 50 is coincident to the reflector focal point 52 and one end of the other filament 51 is close to the focal point. When the first filament 50 whose axis is perpendicular to the reflector axis 4 is energized, a spot beam will be formed. When the second filament 51 whose axis is coincidental with the reflector axis 4 is energized, a broad beam will be formed that is completely illuminated. Also illustrated in FIG. 7 is a typical electrical circuit for energizing the two filaments. Battery 53 provides the power to energize the lamp. Switch 54 can be placed in the neutral position 55 to prevent power from reaching the lamp. When the switch is in position 56 the spot beam filament is energized. When the switch is in position 57 the broad beam is formed. There are a great variety of switching arrangements that are possible and are readily known by those versed in the art.

Figure 8:
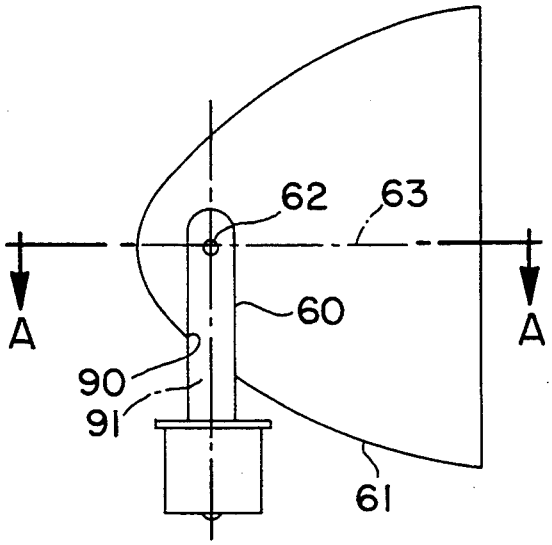
FIG. 8 is a geometric drawing of a single filament lamp according to this invention.
Figure 9:
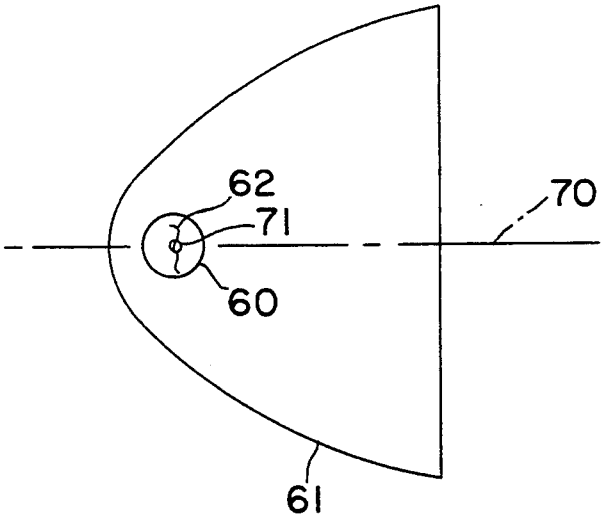
FIG. 9 is a geometric drawing showing the lamp with the filament perpendicular to the reflector axis to form a spot beam.
Figure 10:
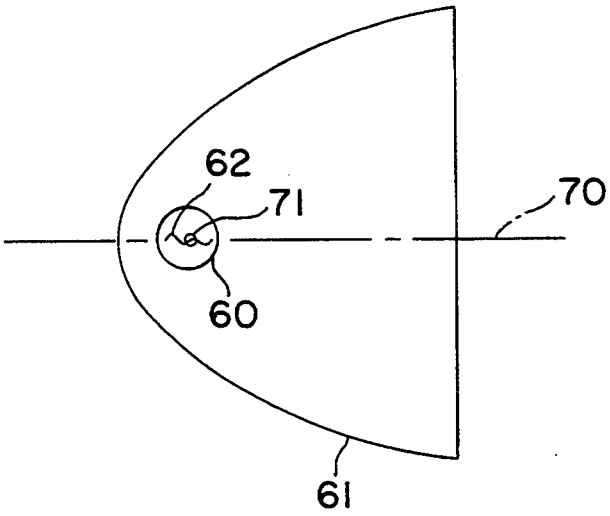
FIG. 10 is a geometric drawing showing the lamp rotated 90 degrees so that the filament is coincident with the reflector axis to produce a broad beam.
Figure 11:
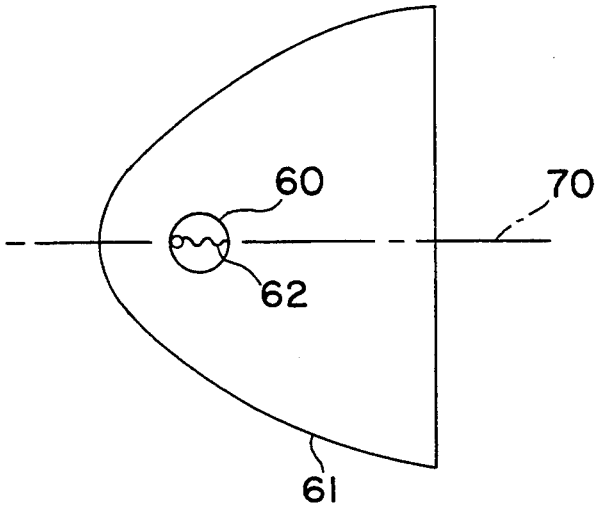
FIG. 11 is a geometric drawing showing the lamp moved so that the end of the filament is at the focal point of the reflector in order to form a larger broad beam.

FIG. 8 illustrates a second embodiment of this invention in which a single filament lamp 60 and a conventional paraboloidal reflector 61 are employed to form the spot and broad beams. The lamp 60 is located within the reflector 61 with the axis of the filament 62 perpendicular to the reflector axis 63 and the center of the filament coinciding with the focal point of the reflector. In this position, a spot beam is formed when the filament is energized. FIGS. 9, 10 and 11 are according to view A—A of FIG. 8.

FIG. 9 illustrates the lamp oriented so that the filament 62 is perpendicular to the reflector axis 70 and the center of the filament 71 is coincident with the reflector focal point. The lamp 60 can be rotated approximately 90 degrees to locate the filament 62 along the axis of the reflector 70 as illustrated in FIG. 10. The beam formed with the lamp in the illustrated position will not be very broad since the center of the filament 71 is located at the focal point and only one-half of the length is off the focus. In order to increase the size of the beam, the lamp can be moved with filament remaining on the axis of the reflector. Movement to place either end of the filament at the focal point of the reflector (FIG. 11) would provide a large broad beam with no black center spot.

For rotation, the lamp is rotationally fitted in an opening 90 through the wall of the reflector. This opening has a bearing axis 91 which intersects the central axis of the reflector. The filament therefore can be rotated to coincide with the central axis, or to be normal to it.

With the configuration illustrated in FIG. 8, both the spot and broad beams will have greater intensity than the conventional arrangement with the lamp inserted through the apex of the reflector. This greater intensity follows because this configuration has a greater projected reflective area. In order to minimize the non-reflective area of the hole to accomodate the lamp, the protective glass bulb around the filament should be as small as possible. For example, to form a desirable sized broad beam with a "D" size battery flashlight, the filament would be at least 0.1 inches long. The glass bulb would then be approximately 0.2 inches in diameter.

Figure 12:
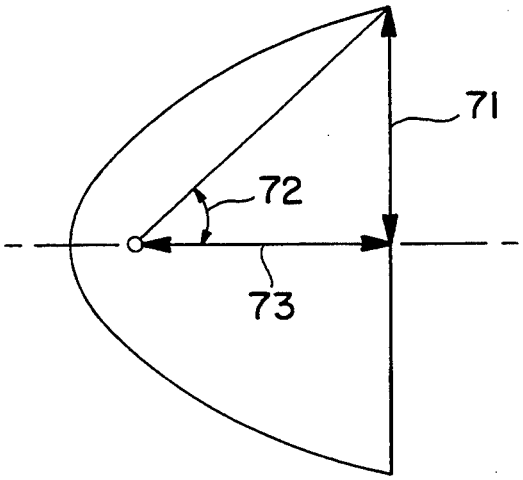
FIG. 12 is a geometric drawing showing the angle between the reflector axis and light ray from the focal point to the maximum diameter.

FIG. 12 illustrates a typical "D" battery size flashlight reflector in which the distance from the focal point to the open end of the reflector 73 is approximately one inch and the radius 71 at the open end location is also approximately one inch. The angle that is formed 72 is approximately 45 degrees for this size reflector. All other size flashlights have approximately the same geometric ratios to result in approximately the same angle. The light that is radiated out of the open end that does not reach the reflector surface is a function of the view angle of the filament to the open end of the reflector. For a filament whose axis is perpendicular to the reflector and whose center is at the focal point as illustrated in FIG. 9, the view factor is 1.0. For a filament whose axis is coincident with the reflector axis as in FIG. 10, the view factor would be sin 45 degrees or 0.707. The result is that the filament that generates the broad beam according to this invention (FIG. 10) would have almost 30 percent more light reflected from the reflector surface than the existing conventional flashlight whose filament is perpendicular to the reflector axis.

In summary this invention provides:

1. A single filament lamp-reflector assembly in which the lamp can be oriented with the reflector to produce either a spot beam or a fully illuminated broad beam.
2. A two filament lamp-reflector assembly that can produce either a spot or a fully illuminated broad beam.
3. A lamp-reflector assembly with an aperture on the side of the reflector to produce a nine percent brighter spot beam and broad beam as the result of having the apex region of the reflector available for directing the light.
4. A lamp-reflector assembly having a filament axis coincident with the reflector axis thereby causing approximately 30 percent increase in the amount of the emitted light from the filament to be reflected to form a more intense broad beam.
5. A lamp-reflector assembly that produces a broad beam having a 39 percent increase in the intensity of the broad beam as the result of eliminating the non-reflective hole in the apex of the conventional reflector and orienting the filament axis coincident with the reflector axis.
6. All five of the above improvements are available with a conventional paraboloidal contoured reflector.

This invention is not to be limited by the embodiments shown in the drawings and described in the description, which are given by way of example and not of limitation, but only in accordance with the scope of the accompanying claims.

I claim:

1. A flashlight comprising:

a reflector having an internal reflecting surface in the shape of a single parabola, said reflector being a continuous surface of revolution about a central axis having an apex and a focal point;

a first linear elongated filament having a dimension of length, said first filament extending normal to and intersecting said central axis;

a second linear elongated filament having a dimension of length and two ends, said filament extending along and coincident with said central axis, one of said ends being closely adjacent to said first filament;

two pairs of conductive lead means connected to said filaments, one pair to each filament; and switch means adapted selectively to connect said filaments to a source of electricity, whereby to energize one or the other to emit light to said reflector to project a broad beam or a spot beam as respective to the location of each filament relative to the central axis and the focal point.

2. A flashlight comprising:

a reflector having an internal reflecting surface in the shape of a single parabola, said reflector being a continuous surface of revolution about a central axis having an apex without an opening, and a focal point, and a side opening through said reflector forming a bearing passage, said bearing passage having a mounting axis normal to and intersecting said central axis;

a bulb mounted in said bearing passage for rotation therein around said mounting axis, a linear elongated filament in said bulb having a dimension of length, said filament being disposed in said reflector so as to intersect said central axis, in one rotary position of the bulb, said filament being normal to said central axis, and in another rotary position being coincident with said central axis;

conductive lead means to said bulb; and switch means connected to said conductive lead means adapted to connect said lead means to a source of electricity or to disconnect said lead means from said source.

3. A flashlight according to claim 1 in which one end of said filament is coincident with said central axis in both of said rotary positions.

4. A flashlight according to claim 1 in which the center point of said filament is coincident with said central axis in both of said rotary positions.

* * * * *